United States Patent [19]

Carmello et al.

[11] Patent Number: 5,008,029

[45] Date of Patent: Apr. 16, 1991

[54] DELAYED ACTION DRAIN CLEANER COMPOSITIONS

[75] Inventors: Robert Carmello, Dumont; Richard D. Miller, Union Beach, both of N.J.

[73] Assignee: Block Drug Company Inc., Jersey City, N.J.

[21] Appl. No.: 439,190

[22] Filed: Nov. 20, 1989

[51] Int. Cl.[5] ..... C11D 7/06; C11D 17/00

[52] U.S. Cl. ..... 252/91; 252/156; 252/174.21

[58] Field of Search ..... 252/90, 91, 156, 174, 252/174.21, 174.22

[56] References Cited

U.S. PATENT DOCUMENTS

| | | | |
|---|---|---|---|
| 4,088,596 | 5/1978 | Arai et al. | 252/99 |
| 4,664,836 | 5/1987 | Taylor, Jr. et al. | 252/156 |
| 4,731,195 | 3/1988 | Olson | 252/91 |

*Primary Examiner*—Paul Lieberman
*Assistant Examiner*—Alexander G. Ghyka
*Attorney, Agent, or Firm*—Ostrolenk, Faber, Gerb & Soffen

[57] ABSTRACT

Sequential coatings of a quickly water soluble or dispersible coating material and a mixture of hydrophobic materials having varying hydrophobic characteristics delay the exothermic reaction which takes place when an alkali metal hydroxide comes into contact with water.

16 Claims, 2 Drawing Sheets

DELAYED ACTION DRAIN CLEANER COMPOSITIONS

BACKGROUND OF THE INVENTION

The present invention relates to drain cleaner compositions. More specifically, the invention is directed towards a drain cleaner having a coating which delays the onset of the exothermic reaction which occurs when alkali metal hydroxide reacts with water such as in crystal-type, alkali metal hydroxide based drain cleaners.

Drain cleaner compositions are well known in the art. Solid drain cleaner compositions are usually based upon strong caustics that generate heat upon addition to water in order to liquefy fats and greases and to dissolve hair and soap curd most usually responsible for plugging up the drain. The caustics attack mold, slime, food particles and the like to further aid in opening up the drain.

Because of the speed and the exothermic nature of the reaction, care must be taken in handling the known drain cleaner compositions. They sometimes contact water prior to their application in the drain as for example during storage. Many attempts have been made to address this problem by including the combination of binders in the drain cleaner pellet as shown in U.S. Pat. No. 4,058,474 and the use of coatings as described in U.S. Pat. No. 4,664,836. As pointed out in the latter patent, very water soluble coatings allow the hydroxide to dissolve quickly but provide less protection against atmospheric moisture during storage while water insoluble coatings require some mechanism to cause the coating to break and release the hydroxide. Neither approach is entirely satisfactory.

It is an object of the invention to provide an improved drain cleaner composition which does not immediately react with water, but rather acts in a time-delayed manner when contacted with moisture. This and other objects of the invention will become apparent to those skilled in the art from the following description and the annexed drawings in which.

SUMMARY OF THE INVENTION

Figure 1:
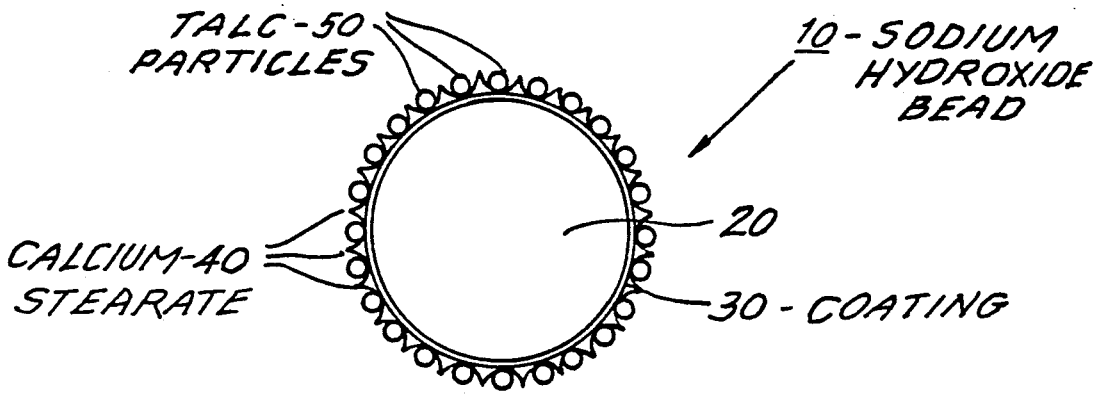
FIG. 1 shows a sodium hydroxide bead coated with a time-delay hydrophobic coating in accordance with the invention.

A caustic type drain cleaner is given temporary hydrophobic characteristics by coating it with a water soluble or dispersible material and a mixture of materials of varying hydrophobic characteristics. By providing a short term time-delay coating with these materials, the onset of the exothermic reaction that occurs when the alkali metal hydroxide contacts water can be temporarily prevented.

DESCRIPTION OF THE INVENTION

The drain cleaner of the present invention comprises a plurality of granules each of which is composed of an alkali metal hydroxide containing two sequential coatings. The inner coating is water soluble or dispersible while the outer coating is hydrophobic. The alkali metal hydroxide is preferably sodium hydroxide which can be present as such or as a mixture with a variety of other materials as is known in the art. In general, the sodium hydroxide constitutes about 40 to 95% by weight of each granule and preferably about 50 to 60% by weight.

The sodium hydroxide granule core has a coating of a quickly water soluble or water dispersible material. The coating should not dissolve or disperse substantially instantaneously in order to provide protection of the sodium hydroxide core from reacting prematurely in the possible presence of trace quantities of water. On the other hand, the coating must dissolve or disperse rapidly in the presence of water at the desired point of use, that is in the drain. Accordingly, the film of the coating material should have the property of dispersing or dissolving in water in more than 5 seconds but less than about 5 minutes and preferably more than about 120 seconds and less than about 180 seconds. The coating composition must also be capable of being applied to the very water reactive hydroxide core under substantially anhydrous conditions such as for instance simple tumbling of the beads and coating material under dry conditions. It is not necessary for the coating to assist in maintaining the free flowing nature of the plurality of granules but of course it should not cause undue agglomeration of the granules. The coating generally comprises about 0.25 to 3 weight % of each granule and preferably about 0.75 to 1.25 weight %.

It is preferred to employ a class of materials known as ethoxylated film-forming surfactants as the quickly water soluble or dispersible coating material. Example include polyoxyethylenepolyoxypropylene copolymers and ethylene oxide condensates with a hydrophobic base such as nonylphenol, octylphenol, tridecyl alcohol, cetyl alcohol, lauryl alcohol, oleyl alcohol, steryl alcohol and the like. These surfactants are readily available commercially.

The quickly water soluble or dispersible coating is itself coated with a mixture of hydrophobic materials in an amount which ranges generally from about 2 to 12% and preferably about 3 to 5% by weight of each granule. The second coating components must of course be capable of application to the coated granule under substantially anhydrous conditions because the presence of water would cause the first coating to dissolve or disperse and activate the hydroxide core. Suitable hydrophobic materials include alkali metal salts of $C_8$–$C_{18}$ fatty acids such as caprylic, capric, lauric, myristic, palmitic and stearic acids, colloidal clays, synthetic clays, metal oxides, alkaline earth metal carbonates, bentonite, feldespar, calcite, dolomite, diatomaceous earth, talc, pumice, silica, silicates and the like. Any number of hydrophobic materials can be blended together as long as at least two of the hydrophobic components have different degrees of hydrophobicity. A material which is less hydrophobic is more easily wet and therefore by combining appropriate amounts of the hydrophobic components, the length of time it takes water located exterior to the coating to reach the quickly water soluble or dispersible coating can be reasonably regulated. A preferred combination of hydrophobic components is talc and calcium stearate in a ratio of about 3:1 and 1:3, and preferably about 1:1 and 1:2. The components of the second coating mixture can be combined in any convenient manner, and even under aqueous conditions as long as the water is eliminated before coating of the granule commences.

Figure 2:
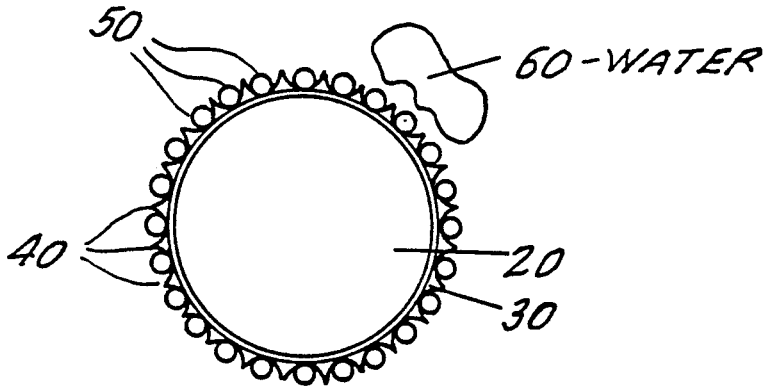
FIG. 2 shows the bead in the presence of water.

Referring now to FIGS. 1–5, a coated sodium hydroxide granule in accordance with the invention is shown generally by reference numeral 10. A sodium hydroxide bead 20 is coated with a first coating comprising a quickly water soluble or dispersible film 30. A second film of preblended hydrophobes calcium stearate 40 and talc 50 coats film 30. The second coating provides areas of varying hydrophobicity which provides areas of greater wetting potential. In this particular combination the talc 50 is more hydrophilic. The presence of water 60 in trace amounts does not wet the talc 50 sufficiently to dissolve or disperse coating 30 and thereby expose the caustic core 20 as shown in FIG. 2.

Figure 3:
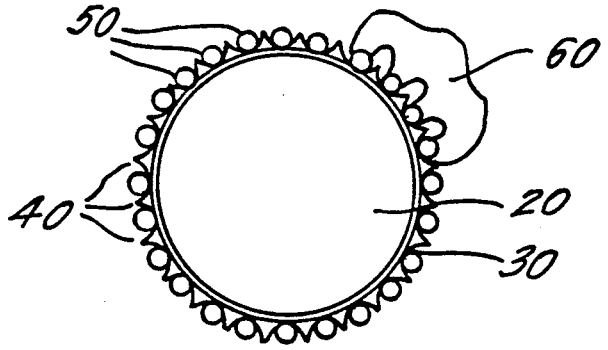
FIG. 3 shows water wetting the exterior coating.
Figure 4:
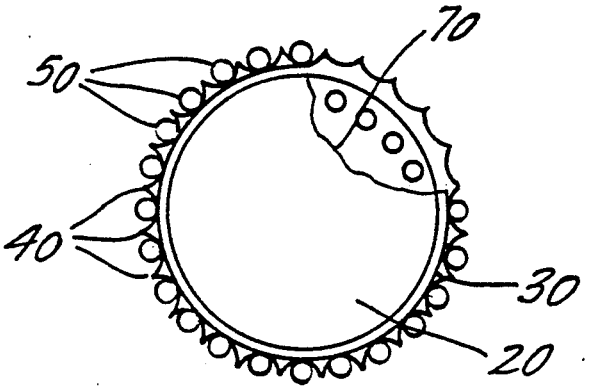
FIG. 4 shows the interior coating being depleted.
Figure 5:
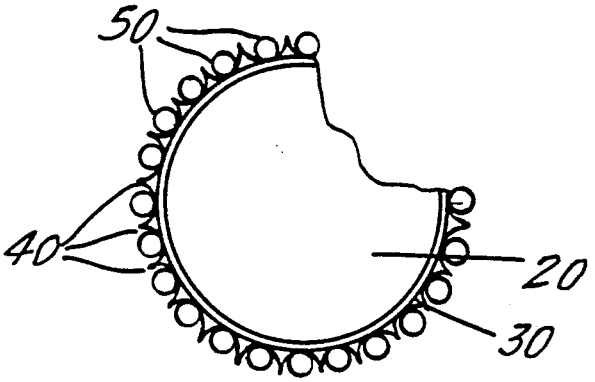
FIG. 5 shows the bead being dissolved and the exothermic reaction commencing.

When in the drain, talc 50 is wet with water 60, as shown in FIG. 3, which allows the water to contact and dissolve or disperse coating 30, as shown in FIG. 4. This in turn results in exposing the sodium hydroxide core 20 in region 70. The sodium hydroxide 20 then comes into contact with the water and undergoes the exothermic reaction as shown in FIG. 5.

In order to further illustrate the present invention, various examples are set forth below. Throughout these examples, as well throughout the balance of this specification and claims, all parts, percentages and ratios are by weight and all temperatures in degrees centigrade unless otherwise indicated.

EXAMPLE 1

Coated sodium hydroxide granules in accordance with the invention are prepared by tumbling 100 parts of anhydrous sodium hydroxide beads in a dry environment with 1.8 parts of a block polyoxyethylenepolyoxypropylene copolymer (Pluronic L-92) to provide a thin film of the copolymer on each bead. A preblended mixture of talc and calcium stearate at a ratio of about 0.6:1 is added to the coated sodium hydroxide beads at a ratio of precoated beads to preblended mixture of about 1:12. The preblend and coated beads are tumbled in a dry environment in any suitable tumbling apparatus. The preblended coating imparts flows properties to the mass as well as coating the beads with a layer of material having varying hydrophobic characteristics.

EXAMPLE 2

Example 1 is repeated except that the quickly water soluble or dispersible material is an ethoxylated nonylphenol (Macol NP-9.5, a non-ionic surfactant).

EXAMPLE 3

Example 1 is repeated using a mixture of aluminum oxide and sodium palmitate in a ratio of about 0.8:1 in place of the mixture of talc and calcium stearate.

EXAMPLE 4

Example 1 is repeated using a mixture of aluminum oxide and potassium stearate in a ratio of about 1:1 in place of the mixture of talc and calcium stearate.

EXAMPLE 5

The granules of Example 1 were placed in water and it is noted that it took about 120 seconds before the exothermic reaction of the sodium hydroxide with the water became evident.

Drain cleaner compositions incorporating coated sodium hydroxide beads in accordance with the invention have several advantages over known drain cleaner compositions. Such compositions provide a safer, crystal-type drain cleaner, extend handling time at the drain while in contact with water, and provide better flow properties of the product while in contact with water.

Various changes and modifications can be made in the present invention without departing from the spirit and scope thereof. The various embodiments which have been described herein were for the purpose of further illustrating the invention but were not intended to limit it.

What is claimed is:

1. A drain cleaner composition comprising a plurality of granules, said granules comprising an alkali metal hydroxide core having a first coating thereon and a second coating on the first coating, said first coating comprising an ethoxylated surfactant, said second coating comprising a mixture of hydrophobic components having varying hydrophobicity individually selected from the group consisting of an alkali metal salt of a $C_8$–$C_{18}$ fatty acid, colloidal clay, synthetic clay, metal oxide, alkaline earth metal carbonate, bentonite, feldspar, calcite, dolomite, diatomaceous earth, talc, pumice, silica and silicate, such that the contact of water with said first coating when the granule is contacted with water is retarded for a finite period of time.

2. The drain cleaner composition of claim 1 in which the alkali metal hydroxide is sodium hydroxide.

3. The drain cleaner composition of claim 1, wherein the surfactant is polyoxyethylenepolyoxypropylene block copolymer.

4. The drain cleaner composition of claim 1, wherein the surfactant is an ethoxylated phenol.

5. The drain cleaner composition of claim 1, wherein the surfactant is an ethoxylated alcohol.

6. The drain cleaner composition of claim 1, wherein said mixture comprises calcium stearate.

7. The drain cleaner composition of claim 6, wherein said mixture comprises talc.

8. The drain cleaner composition according to claim 7 wherein said first coating is about 0.25 to 3 weight % of each granule and said second coating is about 2 to 12 weight % of each granule.

9. The drain cleaner composition of claim 8 wherein said first coating is about 0.75 to 1.25 weight % of each granule and said second coating is about 3 to 5 weight % of each granule.

10. The drain cleaner composition of claim 9 in which the ratio of talc to calcium stearate is about 3:1 to 1:3.

11. The drain cleaner composition of claim 10 in which the ratio of talc to calcium stearate is about 1:1 to 1:2.

12. The drain cleaner composition of claim 1, wherein said mixture comprises talc.

13. The drain cleaner composition according to claim 1 wherein said first coating is about 0.25 to 3 weight % of each granule and said second coating is about 2 to 12 weight % of each granule.

14. The drain cleaner composition of claim 1 wherein said first coating is about 0.75 to 1.25 weight % of each granule and said second coating is about 3 to 5 weight % of each granule.

15. The drain cleaner composition of claim 1, wherein at least one hydrophobic component is a salt of a $C_8$–$C_{18}$ fatty acid.

16. The drain cleaner composition of claim 15, wherein said $C_8$–$C_{18}$ fatty acid is selected from the group consisting of caprylic, capric, lauric, myristic, palmitic and stearic acid.

* * * * *